United States Patent [19]

Romberg

[11] Patent Number: 4,662,111

[45] Date of Patent: May 5, 1987

[54] MECHANISM FOR CONTROLLED CLOSING OF HINGED GATES

[76] Inventor: Felix B. Romberg, P.O. Box 218, Holland, Tex. 76534

[21] Appl. No.: 825,480

[22] Filed: Feb. 3, 1986

[51] Int. Cl.[4] ..... E05B 65/00

[52] U.S. Cl. ..... 49/364; 49/236; 49/386; 16/57; 16/DIG. 17

[58] Field of Search ..... 49/364, 386, 236; 6/51, 6/52, 57, 66, DIG. 9, DIG. 17

[56] References Cited

U.S. PATENT DOCUMENTS

| | | | |
|---|---|---|---|
| 264,098 | 9/1882 | Nichols . | |
| 308,752 | 12/1884 | Cook . | |
| 1,152,999 | 9/1915 | Williamson . | |
| 1,717,473 | 6/1929 | Stewart . | |
| 1,802,599 | 4/1931 | Gross . | |
| 2,076,092 | 4/1937 | Pinard | 39/31 |
| 2,393,418 | 1/1946 | Sawyer | 39/56 |
| 2,430,325 | 11/1947 | Bransky | 39/35 |
| 2,594,033 | 4/1952 | Kemp | 39/40 |
| 2,691,836 | 10/1954 | David | 49/364 X |
| 2,718,079 | 9/1955 | Strey | 39/22 |
| 2,742,722 | 4/1956 | Schaefer | 39/31 |
| 3,049,827 | 8/1962 | Rascov | 49/364 X |
| 3,143,757 | 8/1964 | Quinn | 16/57 |
| 3,378,953 | 4/1968 | Barrowclough | 49/364 |
| 3,490,175 | 1/1970 | Romberg | 49/364 |
| 3,657,842 | 4/1972 | Romberg | 49/364 |
| 3,825,053 | 7/1974 | Romberg | 49/381 |
| 4,378,657 | 4/1983 | Romberg | 49/364 |

FOREIGN PATENT DOCUMENTS

| | | |
|---|---|---|
| 228255 | 9/1959 | Australia . |

*Primary Examiner*—Philip C. Kannan

*Attorney, Agent, or Firm*—Richards, Harris, Medlock & Andrews

[57] ABSTRACT

A hinged driveway gate opened manually or by a vehicle against a closing force is latched in the open position for an adjustable time interval for vehicle passage by the control mechanism having an improved support connection with the gate, an improved latch mechanism, a novel optional power spring, an improved dashpot and a novel protective cover.

20 Claims, 14 Drawing Figures

MECHANISM FOR CONTROLLED CLOSING OF HINGED GATES

TECHNICAL FIELD

This invention pertains to mechanisms for the controlled closing of hinged gates.

BACKGROUND ART

Heretofore a vehicle driver manually opening a gate has been required to stop to close the gate. Vehicle opened gates have been previously used but were held open only briefly by mechanical means, as the driver, being in motion, would drive past the gate quickly. The present invention is not only applicable to vehicle opened gates, but is also especially applicable to the much more common manually opened gates that will require a mechanism which latches the gate in an open position for a much longer and more precise time interval.

DISCLOSURE OF THE INVENTION

This invention is a mechanism for latching a hinged gate in an open position and then unlatching the gate after a predetermined time interval, whereupon the gate closes by means of force provided by a compressed spring or by gravity through an inclined hinge axis, or by a combination of the two.

The top of the gate is hingedly connected to one end of a control rod. The other end of that rod is slidable through a control mechanism that has a vertical pivotable mounting below the control rod to a bar. The bar extends to a pivotable connection with the upper gate hinge and is supported by the gate post.

A control assembly within the control mechanism includes a detent for latching the control rod to hold the gate in its open position. The detent is connected to a novel dashpot that can be adjusted to determine the time interval before the detent releases the control rod for the closing of the gate. The detent, dashpot and associated levers and springs are all above the control rod and are shielded by a removable cover.

The hinged end of the gate can be adjusted relative to the gate post without altering the distance between the gate and the control assembly.

This invention is intended to be a part of a gate installation in which the gate need not be novel but is coordinated with the invention. This invention is not intended to be retrofitable.

DETAILED DESCRIPTION

Figure 1:
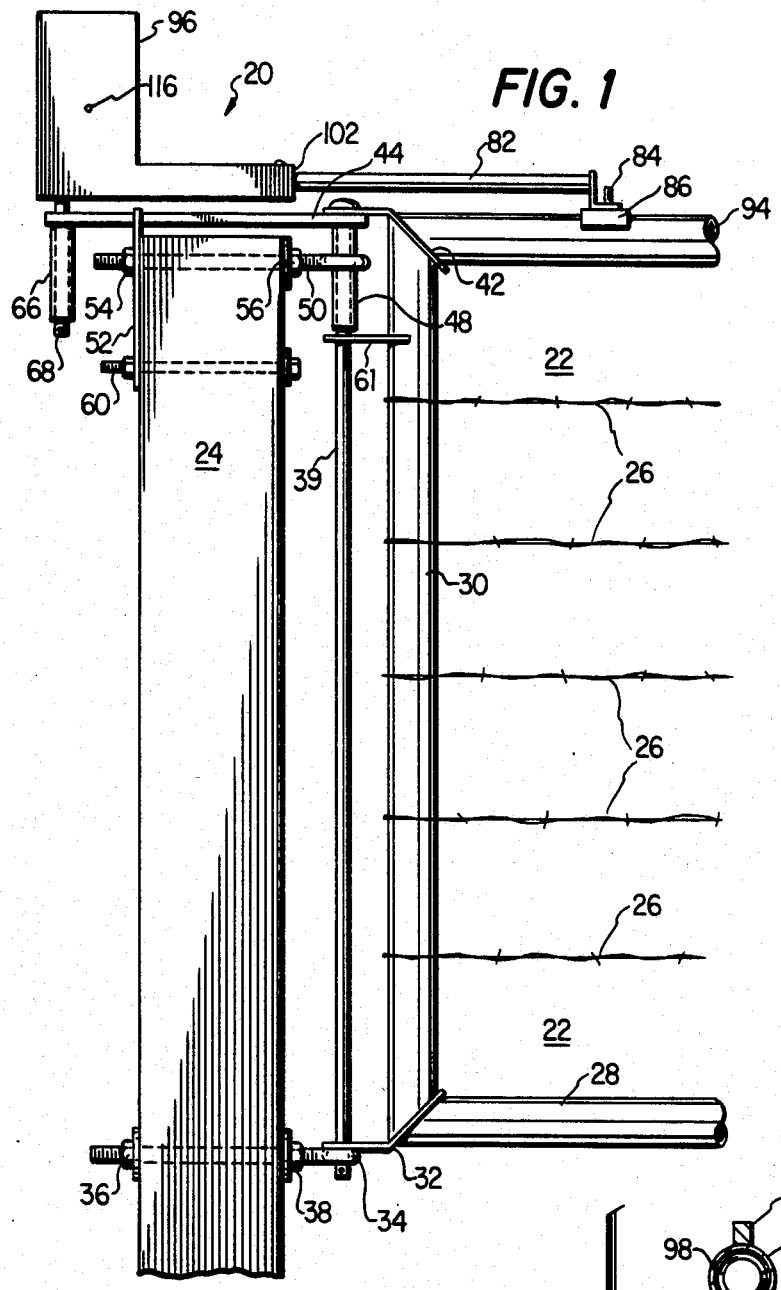
FIG. 1 is a side elevation showing the hinged end of a closed gate, the supporting gate post and the control mechanism of the present invention.

In FIG. 1 of the accompanying drawings, control mechanism 20 comprising the present invention is shown. Control mechanism 20 is applied to gate 22 hinged to gate post 24, which also supports control mechanism 20.

The gate is comprised of a rectangular frame of large diameter thin wall tubing and horizontal barb wires 26. At the lower corner of gate 22, horizontal frame member 28 and vertical frame member 30 are each fixed to lug 32 sandwiched diagonally between them. Lug 32 extends outward as a horizontal element which overlies supporting bolt 34 extending through gate post 24 at the sides of which it is fastened by washers and nuts 36 and 38 for longitudinal adjustment. Bolt 34 and lug 32 are perforated to receive hinge rod 39, the bolt having an expanded end for this purpose.

At the upper corner of the gate, the vertical frame member 30 is similarly connected with the horizontal frame member by means of lug 42 which extends outward horizontally, overlying the end portion of flat bar 44. Lug 42 and bar 44 are each perforated to receive hinge rod 39.

Hinge rod 39 is surrounded by a sleeve 48 which passes through the opening of an eyebolt 50. Eyebolt 50 passes through vertical post 24 and guide plate 52 adjacent the post on the opposite side thereof. Eyebolt 50 is longitudinally adjustable by nuts 54 and 56 on the outside of the guide plate 52. The lower end of plate 52 is secured by a bolt 60 passing through the post. A perforated lug 61 extends from the gate to support the hinge rod 39 below the sleeve 48.

Longitudinal adjustment of either eye bolt 34 or 50 serves to alter the hinge axis of the gate. An inclined axis is a means well known in the art for using gravity to subject the gate to a closing force.

Figure 3:
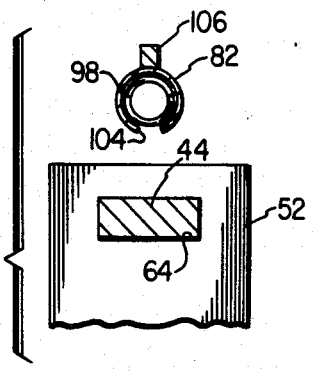
FIG. 3 is a sectional view taken along line 3—3 of FIG. 2.

As seen in FIG. 3, at the upper end of the guide plate 52 there is a rectangular opening 64 matching the cross-section of bar 44, in which bar 44 is received and is longitudinally slidable.

Figure 2:
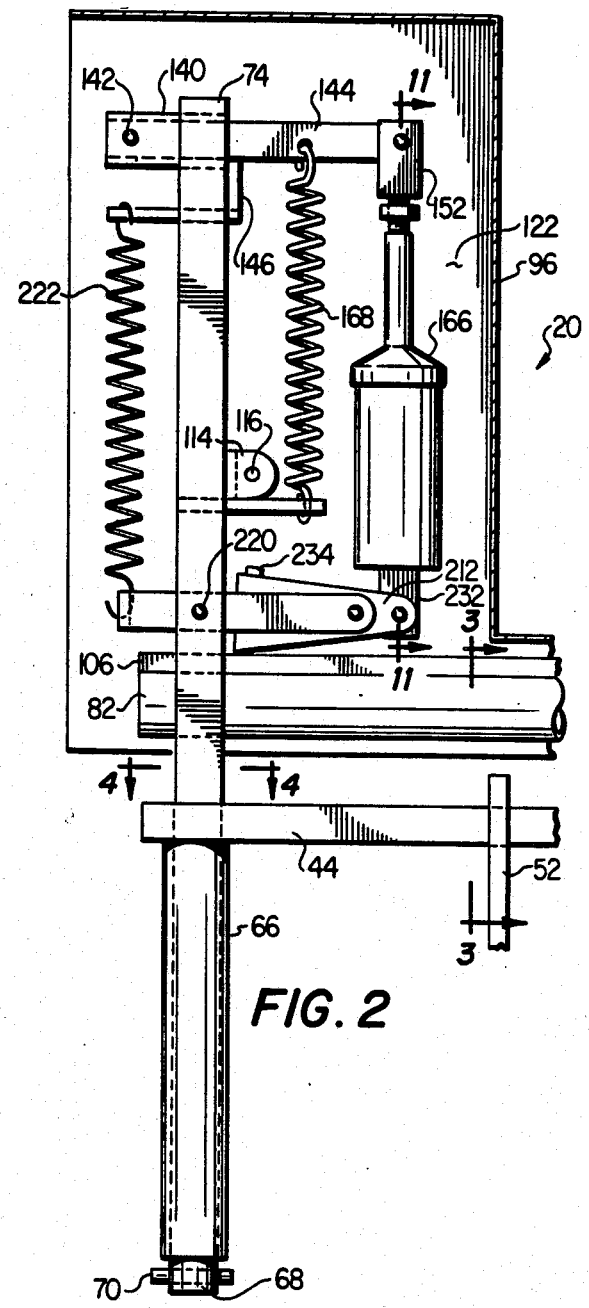
FIG. 2 is a partially broken away side view of the control mechanism of FIG. 1.

As seen in FIG. 2, beyond guide plate 52, bar 44 has sleeve 66 welded vertically to its underside and is perforated in registration with the opening of sleeve 66 to pivotally support pivot shaft 68 vertically. Below the lower end of sleeve 66, the shaft 68 is secured against uplifting by pin 70.

Figure 4:
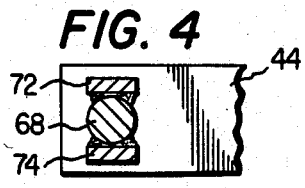
FIG. 4 is a sectional view taken along line 4—4 of FIG. 2.
Figure 5:
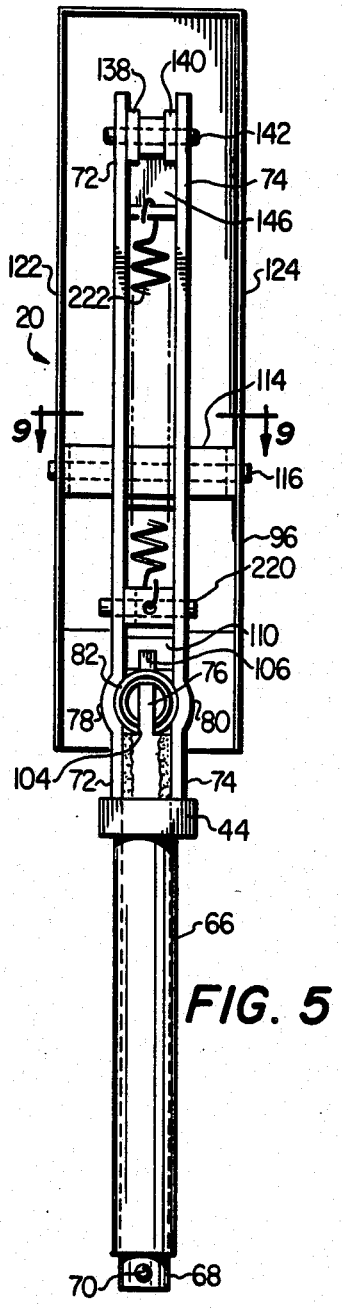
FIG. 5 is a partially broken away end view of the control mechanism of FIG. 2.

As shown in FIGS. 2, 4 and 5, a pair of upright standards 72 and 74 are welded to the shaft 68 with their ends resting on bar 44 for rotation with shaft 68. As shown in FIG. 5, shaft 68 ends at its top with a narrow stump 76 midway between standards 72 and 74 which are bowed outward opposite the stump at 78 and 80 to slidably receive and guide control rod 82 therebetween.

Standards 72 and 74 continue straight and parallel above the bowed portions 78 and 80.

Figure 6:
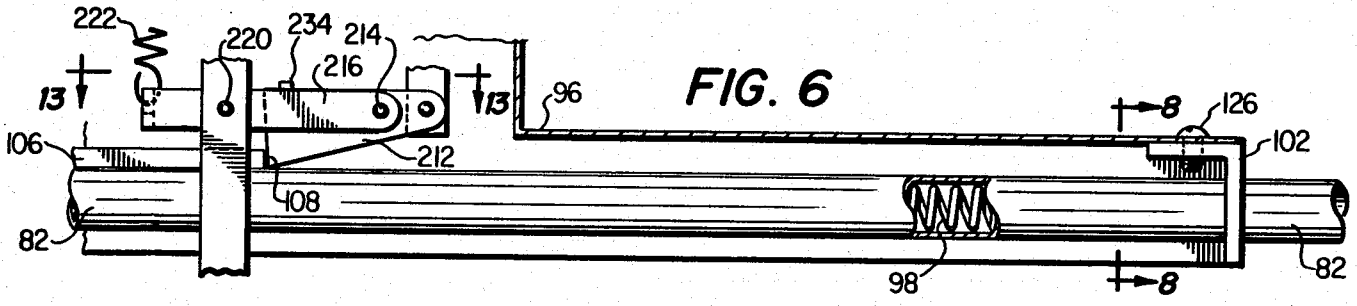
FIG. 6 is a partially broken away detailed side view of the control rod in the position where it is initially gripped by the detent.

When gate 22 is in its closed position, one end of control rod 82 is pinned by an upstanding pivot shaft 84, as shown in FIG. 1, which is integral with a saddle 86 welded to the top of the upper longitudinal frame member 94 of gate 22. The other end of the control rod 82 is located just past standards 72 and 74, but remains under the protective cover 96. Control rod 82 is tubular and houses a compression spring 98 as shown in FIGS. 3 and 6.

Referring now to FIGS. 2 and 5, it w111 be understood that throughout this description and the appended claims the term "control assembly" generally refers to those mechanical elements mounted above control rod 82 and under cover 96. The term "control mechanism" generally refers to the control assembly, control rod 82 and bar 44 and cover 96.

Figure 8:
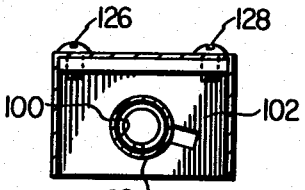
FIG. 8 is a sectional view taken along 8—8 of FIG. 6.

When gate 22 is opened in either direction, pivot shaft 84, as shown in FIG. 1, carries the pivoted end of control rod 82 in an arc whereby control rod 82 slides inward through fitting opening, or guideway, 100, shown in FIG. 8, in end 102 of the protective cover 96. Simultaneously, shaft 68, standards 72 and 74, and all attached thereto is oriented in alignment with control rod 82. The free end of control rod 82 slides outward past standards 72 and 74 and extends from protective cover 96.

One end of compression spring 98 abuts stump 76, shown in FIG. 5, and its other end abuts the closed end of rod 82 proximate pin 84. Spring 98 becomes increasingly compressed between stump 76 and rod 82 as the end of the gate is swung open. That part of control rod 82 which moves between standards 72 and 74 has a slot 104 at its bottom, shown in FIGS. 3 and 5, and crest 106 along its top as shown in FIG. 5. The crest 106 is coextensive with the slot 104 and ends with a face creating shoulder 108 for engagement by the detent. As seen in FIG. 5, slot 104 receives stump 76 while crest 106 is received by guide block 110 in which it slides. Guide block 110 is integral with standards 72 and 74.

Figure 9:
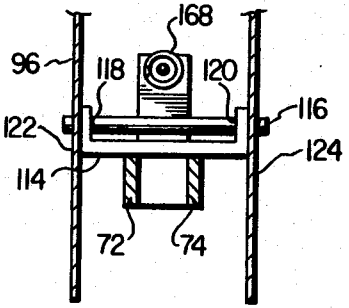
FIG. 9 is a sectional view taken along line 9—9 of FIG. 5, but with the spring 222 cut away.

As shown in FIGS. 2, 5 and 9, a horizontal crossbar 114 is integral with standards 72 and 74 and is bent perpendicularly at its ends to fit the sides of cover 96. A pivot pin 116, shown also in FIG. 1, projects through openings 118 and 120 in the bent ends of crossbar 114 and through openings in the adjacent sidewalls 122 and 124 of protective cover 96. To remove the cover 96 while the control rod 82 remains in place, screws 126 and 128, shown in FIGS. 6 and 8, are first removed to release the end piece 102, then the pivot pin 116 is withdrawn. Cover 96 remains in vertical adjustment with control rod 82 at the endpiece 102 by pivoting at pin 116.

Figure 10:
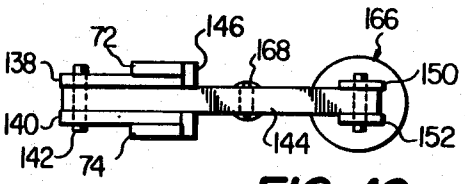
FIG. 10 is a plan view of the uppermost part of the control assembly as seen after the protective cover is cut away.

As seen in FIGS. 2, 5 and 10, at the upper ends of standards 72 and 74 arms 138 and 140 extend from the inner sides of standards 72 and 74 perpendicularly to pivot pin 142. Pin 142 passes through these arms and retains lever 144 between them. Lever 144 normally rests on cross piece 146 integrally connecting standards 72 and 74, and extends to a pivot pin 148 pivotally connecting lever 144 with projections 150 and 152 of dashpot assembly 166. Strong tension spring 168 normally keeps the lever 144 seated on cross piece 146.

Figure 12:
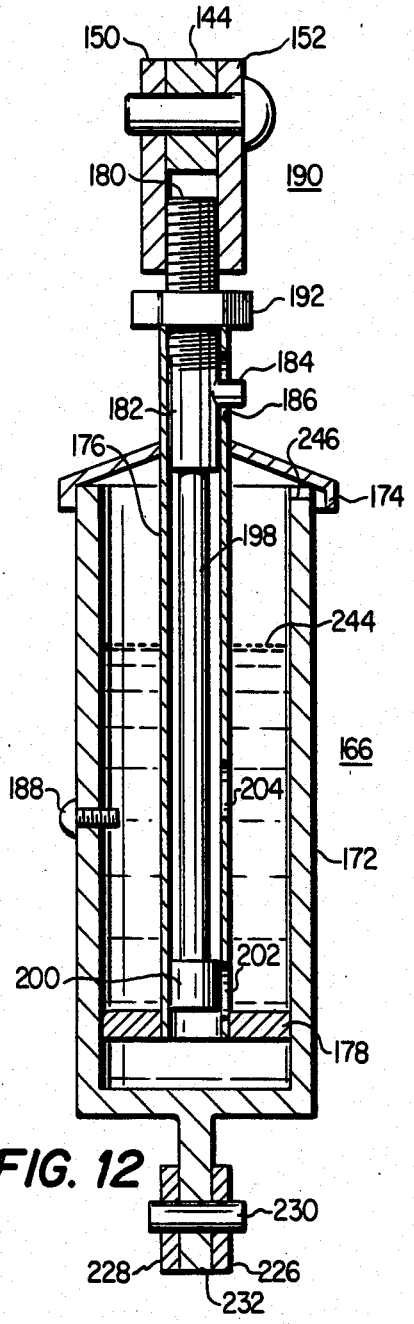
FIG. 12 is a view similar to FIG. 11, but with the dashpot in its fully compressed position.
Figure 11:
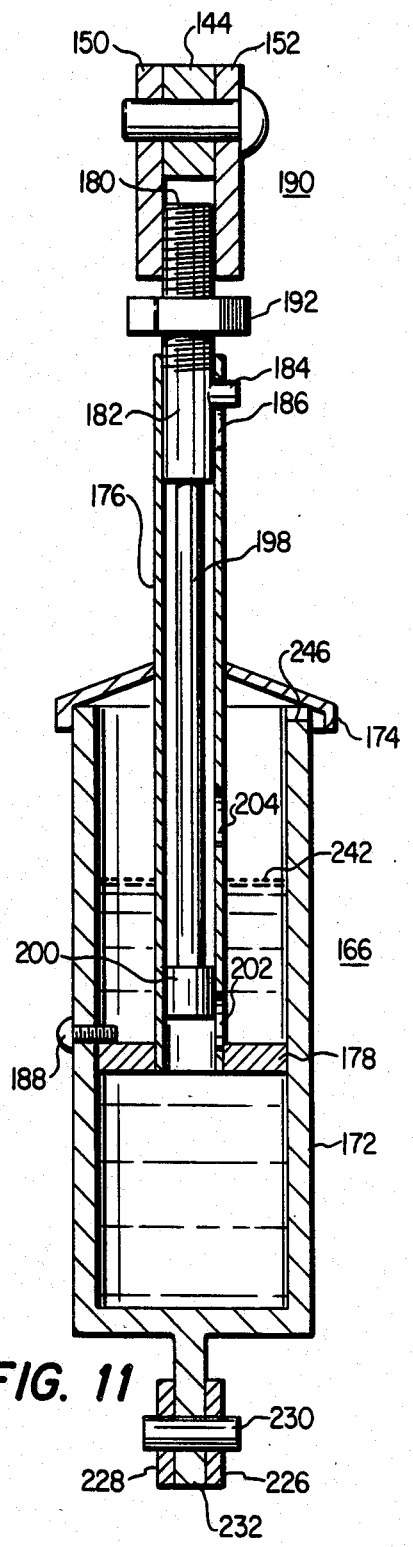
FIG. 11 is an enlarged view of the dashpot assembly taken along line 11—11 of FIG. 2.

Referring now to the dashpot assembly 166 shown in FIGS. 2, 11 and 12, cylinder 172 preferably has a transparent wall to make the interior visible. Cylinder 172 is topped by lid 174 which may be fastened to it in any suitable manner. Lid 174 has a central opening slidably receiving a tubular piston rod 176. To and about the lower end of tubular piston rod 176 piston 178 is rigidly secured, leaving the tubular piston rod open at the bottom.

Screw rod 180 has an unthreaded portion 182 extending into the upper end of the tubular piston rod 176. From the side of this unthreaded portion 182 of the screw rod 180 pin 184 projects through a longitudinal slot 186 in the tubular piston rod 176 to limit the downward movement of said piston rod. Screw 188 projects through the wall of cylinder 172 to limit the downward movement of cylinder 172 relative to piston 178.

Screw rod 180 is threaded above the tubular piston rod and makes a threaded connection with end piece 190 which ends with projections 150 and 152. Nut 192 is located between end piece 190 and the end of tubular piston rod 176 and is adjustable along said threaded portion of screw rod 180.

Rod 198 is of small diameter and extends from the lower end of the screw rod 180 to valve piston 200. When piston 178 is in its lowest position piston 200 clears most of port 202 in tubular rod 176 as shown in FIG. 11. This small diameter rod 198 is sufficiently smaller than the interior diameter of the tubular piston rod to avoid liquid rising high in the tube by way of capillary action. A special opening 204 in the wall of the piston rod tube equalizes the height of the liquid inside and outside the tubular piston rod 176.

Figure 7:
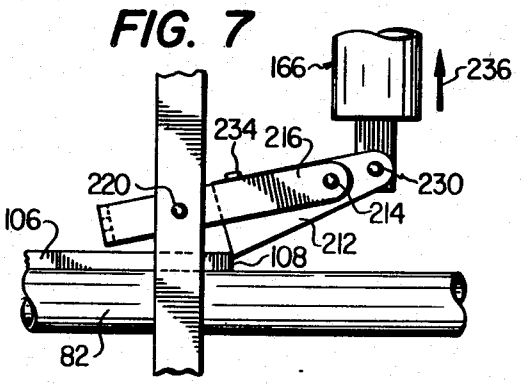
FIG. 7 is a partially broken away detailed side view of the detent rotating under the force of the control rod.

As shown in FIGS. 2, 6, 13 and 14, detent 212 is pivotally secured by pin 214 within and to one end of bifurcated lever 216. Lever 216 extends between standards 72 and 74 to a union 218 and is pivotally secured by shaft 220, extending through standards 72 and 74. Beyond pivot pin 214, detent 212 has two forks 226 and 228 shown in FIGS. 13 and 14. Pin 230 connects these forks with lug 232 extending therebetween from the bottom of the cylinder 172 as shown in FIGS. 11 and 12. Cross piece 234 is attached to detent 212 so as to prohibit said detent's rotation about pin 214 beyond the point at which cross piece 234 bridges bifurcated lever 216. As seen in FIGS. 2, 6 and 7, cross piece 234 serves to limit rotation of detent 212 in the counter clockwise direction. Rotation of detent 212 in the clockwise direction is checked by dashpot assembly 166.

For gates openable in both directions, the sleeve 66, the sleeve 48 and the shaft 84 are in alignment when the gate is in its closed position. Most manually opened gates are openable in only one direction, for which that alignment is not essential. The shaft 84 may then be set on that side of the gate to which the gate opens. Also for gates openable in only one direction, it is advantageous to offset the lower eyebolt 34 in the gate's openable direction relative to the upper eyebolt 50 and generate all or a major part of the gate closing force by means of the thus inclined hinge axis.

The control mechanism is not a separate apparatus retrofitable on installed gates, but is a part of the gate installation. The flat support bar 44 must be mounted perpendicular to the hinge axis of the gate by positioning of the plate 52. The hinge axis of the control assembly should be parallel with the gate's hinge axis, and the bar 44 and control rod 82 should be in nearly parallel planes.

The degree to which the gate is openable in either direction is limited by stop means such as short posts set in the gate's swing path at the time of installation. Thus, when gate 22 is opened in either direction, control rod 82 moves from the position shown in FIG. 2 to just beyond the position shown in FIG. 6. Thus, the lower end of detent 212 rides on crest 106 until crest 106 has passed, and then drops behind shoulder 108 aided by the tension of weak spring 222.

Figure 13:
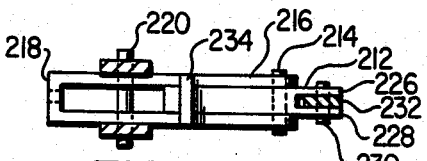
FIG. 13 is a sectional view taken along line 13—13 of FIG. 6, but with the spring cut away.
Figure 14:
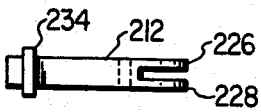
FIG. 14 is a plan view of the detent.

After the gate has engaged the short post set to stop its opening swing, it rebounds due to the resilience of the gate and the force of compression spring 98 located within control rod 82 or an optional force generated by an inclined hinge axis. At that point, the end of crest 106 presses against the end of detent 212 at shoulder 108 causing lever 216 to pivot at shaft 220 against the tension of weak spring 222, whereby pivot pin 230 exerts a vertical force on dashpot assembly 166 as shown by arrow 236 in FIG. 7. As seen in FIGS. 9, 13 and 14, crossbar 234 extends across the top of detent 212 and bridges the forks of lever 216 to limit the downward movement of that end of detent 212 relative to lever 216.

As detent 212 rotates under the force exerted by crest 106, it is braced against lever 216 by crossbar 234 and rotates with lever 216 about point 220 causing dashpot assembly 166 to be compressed. As dashpot assembly 166 is compressed, cylinder 172 rises with piston 178 rising with it until the upper end of the tubular piston rod 176 contacts the adjusting nut 192, thereby nearly closing port 202 with the presence of valve piston 200. Thereafter, dashpot assembly 166 is compressed at a reduced rate controllable by adjusting the height at which tubular piston rod 176 contacts adjusting nut 192.

In the preferred embodiment, the hydraulic fluid used in cylinder 172 is silicone oil having relatively small changes in viscosity with changes in temperature. The rate at which the fluid flow bypasses piston 178 through port 202 can be selected by manipulating nut 192 to determine the exact point during compression of dashpot 166 that travel of tubular piston rod 176 is stopped and how far valve piston 200 closes said port. When dashpot assembly 166 has been compressed sufficiently, cylinder 172 will have risen from the position shown in FIG. 11 to the position shown in FIG. 12 under the force of the control rod 82 acting through detent 212. When dashpot 166 has reached the position shown in FIG. 12, detent 212 is released from crest 106 of control rod 82 by rotating clear of the shoulder 108 provided by crest 106. The gate is then free to close. When dashpot 166 is in its full elongated position shown in FIG. 11, the top of the silicone fluid may be at point 242. It may rise to point 244 shown in FIG. 12. The displaced air may escape from the cylinder through vent 246.

After detent 212 has been released from crest 106, weak spring 222 will exert a downward pull to dashpot assembly 166 through lever 216, thereby pulling it to its fully elongated state shown in FIG. 11. This initially lowers the piston 178 due to its weight, friction with the cylinder wall and suction created in the liquid. The lowering of the piston opens the port 202 by lowering said port in relation to valve piston 200. This results in rapid flow of the silicone liquid through port 202, allowing dashpot assembly to return to its fully elongated state.

Strong spring 168 does not yield in the normal operation of the dashpot assembly. However, if someone would attempt to forcibly close the gate before detent 212 became unlatched from crest 106 in the normal manner, spring 168 would yield under the force of dashpot assembly 166 to avoid overstraining the elements of control mechanism 20.

When the gate with the control mechanism is in service, it is expected that the hinge axis of the gate will not be nor remain precisely parallel in all directions with the pivot shaft 68, nor be exactly perpendicular with the control rod as seen in FIG. 1. Hence, when the gate is swung between closed and open positions, the angle between the control rod and the standards 72 and 74, as seen in FIG. 6, will change back and forth, forcing pivoting of the cover 96 at the pivot pin 116 as the endpiece 102 rides on the control rod 82.

Cover 96 protects the smaller parts of control mechanism 20 from wetting, freezing, wind carried objects, and tinkering by humans and animals. Also, the control mechanism may be turned end for end so that pivot shaft 68 is mounted on gate 20 and pivot shaft 84 is located at the end of flat bar 44 most distant gate 22.

The present invention can be used on automatically or manually opened gates. It can be used on one of a pair of gates which are swung from opposite sides of a driveway, of which only one gate is opened for ordinary vehicle traffic. It can also be used for gates openable in both directions and for gates opened in only one direction. It can be used for gates which are merely latched when swung shut and for gates which are locked when swung shut. Additionally, it will be understood that instead of a mechanical dashpot assembly used to time the release of crest 106 an electrical timer may be used.

Although particular embodiments of the invention have been illustrated in the accompanying drawings and described in the foregoing Detailed Description, it will be understood that the invention is not limited to the embodiments disclosed, but is intended to embrace any alternatives, equivalents, modifications and rearrangements of elements falling within the scope of the invention as defined by the following claims.

I claim:

1. A control mechanism for a gate connected hingedly to a supporting gate post at a hinge axis and openable against a closing force from a normal closed position to a normal open position, comprising:

a control assembly for latching the gate in its open position for a predetermined time interval;

a support arm connected to the post and pivotally supporting said control assembly for rotation about an axis substantially parallel to the gate's hinge axis;

said control assembly having first and second guideways;

a control rod pivotally connected at one end to the gate at a location offset from the gate hinge axis;

said control rod being slidably retained through said first and second guideways;

said control assembly having an upright frame defining said first guideway;

a first lever hingedly supported by said frame above said control rod and extending toward said end of said control rod connected to the gate;

a detent mounted on said first lever and engageable with said control rod;

said control rod having a shoulder facing toward its said end connected to the gate and engageable with said detent to latch the gate when the gate is in its open position;

said shoulder being moved toward said first guideway past said detent when said gate is opened to its open position;

said first lever being pivotal about an axis in response to the closing force of said gate transmitted by said shoulder against said detent to swing said combined detent and lever free of said shoulder; and means for checking the movement of said first lever to delay for a predetermined time interval the release of said shoulder from said detent.

2. The control mechanism according to claim 1 wherein said detent is a second lever hingedly connected to said first lever and extends beyond said first lever to a pivotal connection with a dashpot.

3. The control mechanism according to claim 2 wherein said first lever also includes two spaced apart members, and said detent is hingedly connected between said two members of said first lever.

4. The control mechanism according to claim 2 in which said detent has means to limit its downward movement relative to said first lever.

5. The control mechanism according to claim 1 in which said lever has first and second portions extending in opposite directions from its hinged support on said frame, the first portion being connected to said detent, and the second portion being connection to a tension spring extending upward to an attachment with said frame.

6. The control mechanism according to claim 1 in which said second guideway comprises an opening in a protective cover pivotally connected to said frame such that said second guideway is vertically adjusted to changes in the angle between said control rod and said frame.

7. The mechanism according to claim 1 in which said support arm is connected at one end to a hinge shaft, the gate being supported by said hinge shaft at an upper hinged corner of the gate, and the support arm being supported by a guide plate secured to the side of the gate post opposite the hinge shaft.

8. The mechanism according to claim 7 in which said support arm is a flat bar and said supporting guide plate defines an opening admitting said bar and limiting said bar to longitudinal movement therein.

9. The mechanism according to claim 1 in which said control rod is tubular and encloses a compression spring, with that end of said tubular control rod which is slidable in said first guide means being slotted at the bottom with a frame portion projecting through said slot into said tube to confine said spring, and with a crest along the top providing at its end said shoulder engaged by said detent.

10. A mechanism for controlled closing of a driveway gate swingable laterally in one direction from a normal closed position to a normal opened position and hingedly connected to a supporting gate post at top and bottom hinge pivots, the bottom hinge pivot being offset in the gate's opening direction relative to the top hinge pivot, comprising:

an arm connected to and extending from said gate in a direction away from the gate in its closed position;

vertical pivot means connected to said arm;

a frame connected with said vertical pivot means for lateral pivotal movements and extending upward from said pivot means;

said frame defining a first guideway;

a cover supported by said frame;

said cover defining a second guideway remote from said first guideway;

a tubular control rod pinned at one end to said gate at a point offset from said hinge pivots;

said control rod being mounted for longitudinally slidable movement through said first and second guideways;

said tubular control rod being slotted along the bottom and having an integral crest at its top;

said crest ending with a shoulder facing said pinned end of said control rod;

a stud on said frame extending through said slot into said tubular control rod;

a helical compression spring confined inside said control rod and bearing against said stud;

a detent pivotally engageable against said shoulder of said crest when said shoulder is moved past said detent by opening said gate;

means to connect said detent with said frame; and means for disengaging said detent from said shoulder after a predetermined time interval.

11. The control mechanism according to claim 10 and further having said second guideway between said first guideway and the pinned end of said control rod.

12. For controlled closing of a laterally swinging driveway gate hingedly connected to a supporting gate post and having means to urge it from a normal open position to a normal closed position, a mechanism interposed between the gate and stationary structure connected with the gate post, comprising:

a frame connected for lateral pivotal movements with respect to the gate post;

dashpot means offset from and connected at its upper end with said frame;

a cover supported by said frame and covering said dashpot means;

said frame defining a first guideway;

said cover defining a second guideway remote from said first guideway;

a control rod slidable longitudinally through said first and second guideways;

said control rod having a shoulder between said first and second guideways, facing said second guideway;

a forked lever having a hinged connection with said frame above said control rod, its forks extending toward said second guideway;

a detent extending between said forks and having a hinged connection therewith at the ends of said two forks;

said detent extending beyond said forks to a pivotal connection with the lower end of said dashpot means;

the other end of said detent being engageable with the face of said shoulder of the control rod;

means to urge the hinged connection between said lever and said detent downwardly and thereby urge said detent down behind said shoulder of the control rod, when said control rod moves said shoulder towards said first guideway past the end of said detent; and means to limit the downward movement of the shoulder engaging end of said detent relative to said forked lever, such that subsequent tension of said control rod against said detent will urge said detent with said forked lever to pivot in an arc described about said lever's hinged connection with said frame, while said dashpot means yields to upward pressure, until the shoulder of said control rod is released by said detent.

13. The mechanism of claim 12 with said cover pivotally connected to said frame in a plane allowing said cover to pivot vertically at said second guideway.

14. The mechanism of claim 12 wherein said frame is supported at a first end of an arm, the second end of said arm being pivotally connected to the hinged end of the gate, and said control rod being pivotally connected beyond said second guideway from said detent to the gate beyond its hinged end.

15. The mechanism according to claim 12 in which said frame includes an upright pair of spaced apart standards, and said fork lever extends beyond a pivotal connection with said standards from said detent to a tension spring extending upward to a projection from said standards.

16. A dashpot comprising:

a. chamber with a cylindrical wall;

a main piston in said chamber and slidable within said wall;

a tubular piston rod integral with said main piston;

a cover for said chamber having an orifice and supporting said piston rod for longitudinal slidable movement;

said tubular piston rod having a port in its side wall communicatable with the chamber beneath said main piston;

a longitudinal element extending inside said tubular piston rod from said port to beyond the upper end of said piston rod and being longitudinally slidable in said piston rod;

means to limit the relative longitudinal movement between said piston rod and said longitudinal element; and the lower end of said longitudinal element being a valve piston defining the effective opening of said port.

17. The dashpot according to claim 16, further having screw means on said longitudinal element above the upper end of said piston rod for adjusting the extent to which the port is closed by said valve piston.

18. The dashpot according to claim 16 with said means for limiting said movement between said piston rod and said longitudinal element comprising a longitudinal slot in said piston rod and a pin projecting through said slot from said longitudinal element.

19. The dashpot according to claim 18, in which said longitudinal element has a smaller diameter interval between said valve piston and the uppermost section bearing said pin.

20. A dashpot comprising:

an upright cylinder for containing an hydraulic fluid;

a first piston in said cylinder;

an upright tubular piston rod connected to said first piston and having its interior communicating with the space below said first piston;

means to slidably align said piston rod with said cylinder;

a port in the side wall of said piston rod near said first piston;

a second piston slidable in said piston rod at said port;

a slide rod connected with said second piston and extending within and beyond the upper end of said tubular piston rod;

a longitudinal slot near the upper end of said piston rod;

a pin projecting from said slide rod through said slot;

the upper end of said slide rod being threaded; and screw means adjustable along said threaded portion of said slide rod, by means of which the effective minimum port opening may be adjusted.

* * * * *